US006321494B1

(12) United States Patent
Öberg

(10) Patent No.: US 6,321,494 B1
(45) Date of Patent: Nov. 27, 2001

(54) WINDOW STRUCTURE

(75) Inventor: Olle Öberg, Manganvägen 7, Täby S-187 46 (SE)

(73) Assignee: Olle Oberg, Taby (SE)

( * ) Notice: Subject to any disclaimer, the term of this patent is extended or adjusted under 35 U.S.C. 154(b) by 0 days.

(21) Appl. No.: 08/983,384

(22) PCT Filed: May 30, 1996

(86) PCT No.: PCT/SE96/00700

§ 371 Date: Jan. 16, 1998

§ 102(e) Date: Jan. 16, 1998

(87) PCT Pub. No.: WO97/04206

PCT Pub. Date: Feb. 6, 1997

(30) Foreign Application Priority Data

Jul. 17, 1995 (SE) ..... 9502624

(51) Int. Cl.[7] ..... E06B 3/964

(52) U.S. Cl. ..... 52/204.66; 52/204.62; 52/204.593; 49/381

(58) Field of Search ..... 52/207, 204.5, 52/204.53, 204.54, 204.591, 204.593, 204.6, 204.62, 204.66; 49/381, 501

(56) References Cited

U.S. PATENT DOCUMENTS

| | | | | |
|---|---|---|---|---|
| 3,802,127 | * | 4/1974 | Silvernail | 49/397 |
| 3,878,648 | * | 4/1975 | Maune | 49/400 |
| 4,392,330 | * | 7/1983 | Buhr | 49/381 |
| 4,502,249 | * | 3/1985 | Banford | 49/381 |
| 5,315,798 | * | 5/1994 | Zarwell | 49/400 X |
| 5,355,625 | * | 10/1994 | Matsuoka | 49/400 |

FOREIGN PATENT DOCUMENTS 367616 4/1963 (CH) .

* cited by examiner

*Primary Examiner*—Beth A Aubrey
(74) *Attorney, Agent, or Firm*—Mark Farber

(57) ABSTRACT

A window structure comprises a fame and an inwardly opening window leaf of a multi glazing type composed of a wooden casement as well as two glass panes. The outer glass pane consists of safety glass, e.g. tempered or laminated glass and the casement which carries the inner glass pane being in its entirety located on the inside of the outer glass pane and connected thereto, the outer glass pane having, in the closed state of the window leaf, its edge portions located between the casement and inwardly facing shoulder surfaces on the frame.

14 Claims, 4 Drawing Sheets

WINDOW STRUCTURE

TECHNICAL FIELD OF THE INVENTION

Figure 1:
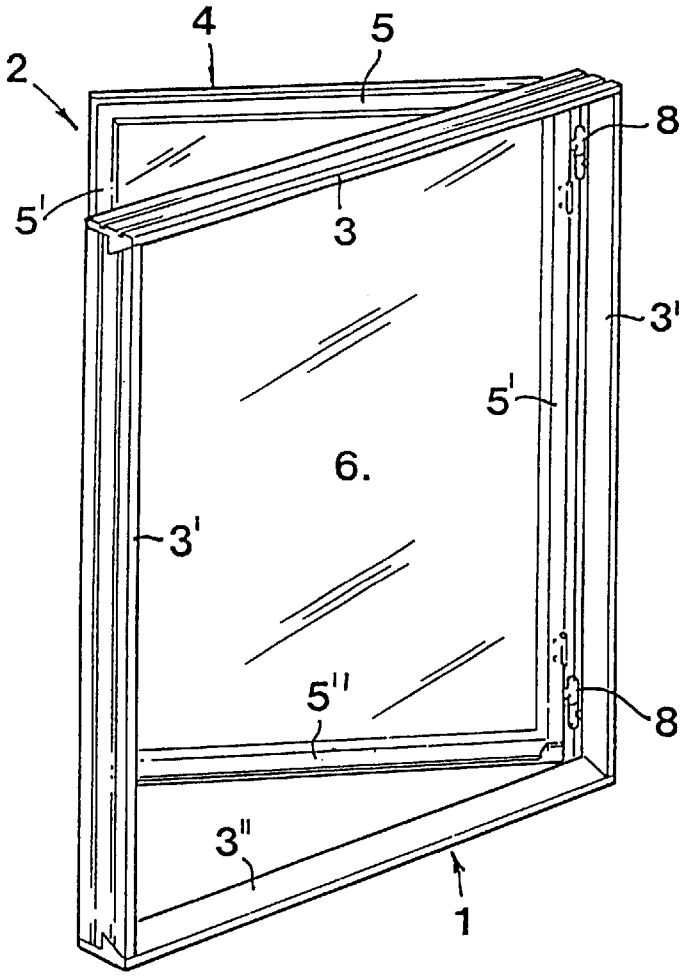

This invention relates to a window structure comprising a frame and an inwardly opening window leaf of a multi glazing type composed of a wooden casement as well as at least two glass panes.

BACKGROUND OF THE INVENTION AND PRIOR ART

Traditionally, the window leaves of previously known wooden window structures have been made with a carrying or supporting casement which surrounds a glass irrespective of whether the window leaf has the form of a single glass or if it comprises one or more additional glasses arranged in inner casements connected to an outer casement. The function of the casement is to form the carrying framework of the window leaf and for this purpose the casement includes wooden portions located inside as well as outside the glass or the outer glass. The outwardly exposed portions of the outer casement will then always be exposed to climatological stresses in the form of alternate moisture loads, wind and direct insolation. During periods of varying temperature the outer glass pane, most often puttied, will be exposed to alternating cold and heat. The glass material has completely other physical shrinkage characteristics than the wood material of the casement, which leads to strong alternate stress loads on the putty joint between the glass pane and the casement. Cracks will arise relatively fast in the putty joint leading to moisture penetration in the woodwork of the casement with the ensuing rot damage, in particular in the bottom part of the casement, which has relatively unprotected cross-cut wood in the corner joints where the side pieces of the casement meet the bottom piece thereof. In order to counteract dilapidation of the window leaves, constantly recurring maintenance of painting, completion of putty and the like, is required.

OBJECTS AND FEATURES OF THE INVENTION

The present invention aims at removing the above-mentioned disadvantages of previously known wooden window structures of the kind initially related to and at creating an improved window structure. Thus, a primary object of the invention is to create a window structure having a window leaf the wooden casement of which is effectively protected against such climatological influences which may lead to rot in the casement. A further object is to connect the outer glass pane of the window leaf to the casement by means of means which do not, as easily as window putty, run the risk of being quickly destroyed as a consequence of variations of temperature and insolation. Another object of the invention is to create a window structure which in its entirety offers a large viewing or panoramic angle for an observer being indoors. A further object is to create a window structure with an improved safety against burglary. It is also an object to create a window structure which is constructionally simple, has a long lifetime and requires a minimum of maintenance.

According to the invention, at least the primary object is attained by the features defined in the characterising clause of claim 1. Preferred embodiments of the invention are furthermore defined in the dependent claims.

BRIEF DESCRIPTION OF THE APPENDED DRAWINGS

Figure 4:
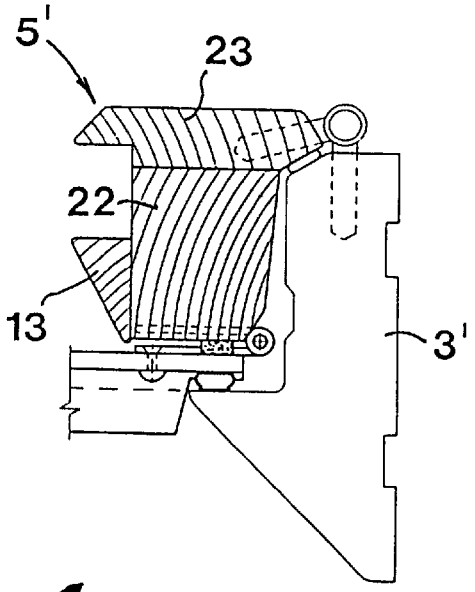
Figure 2:
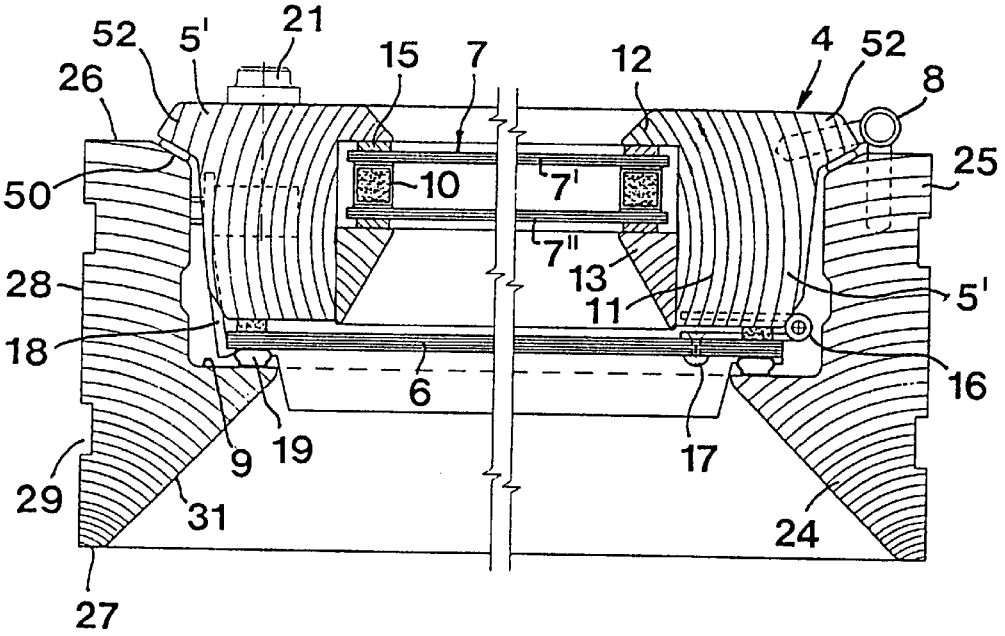
Figure 3:
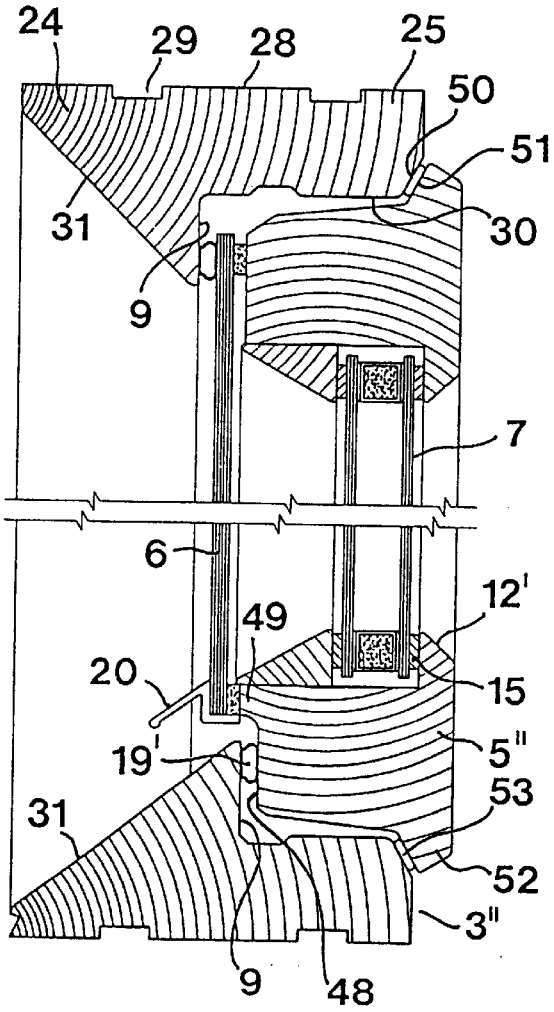
Figure 5:
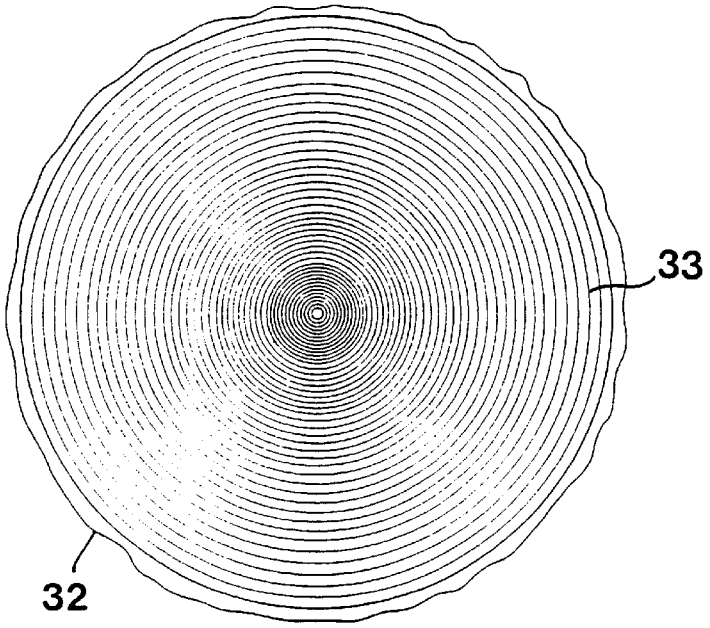
Figure 6:
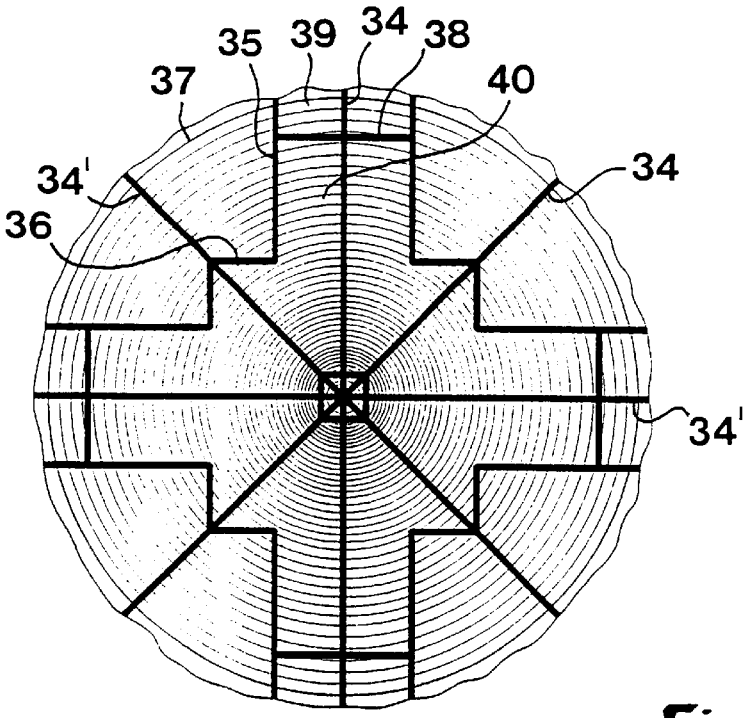
Figure 7:
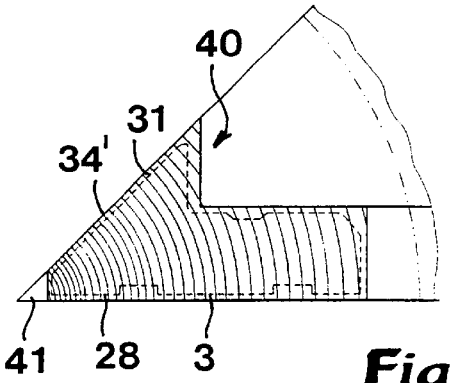
Figure 8:
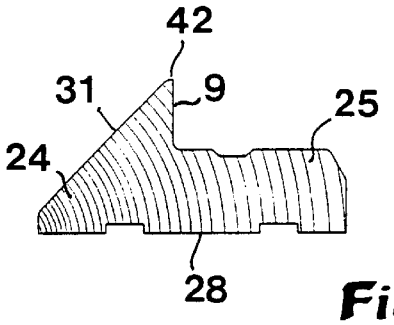
Figure 9:
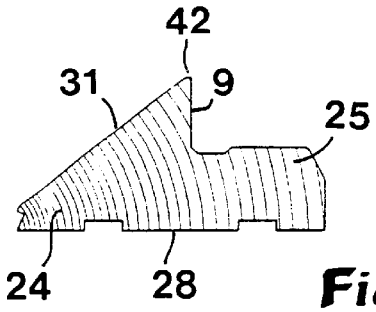
Figure 11:
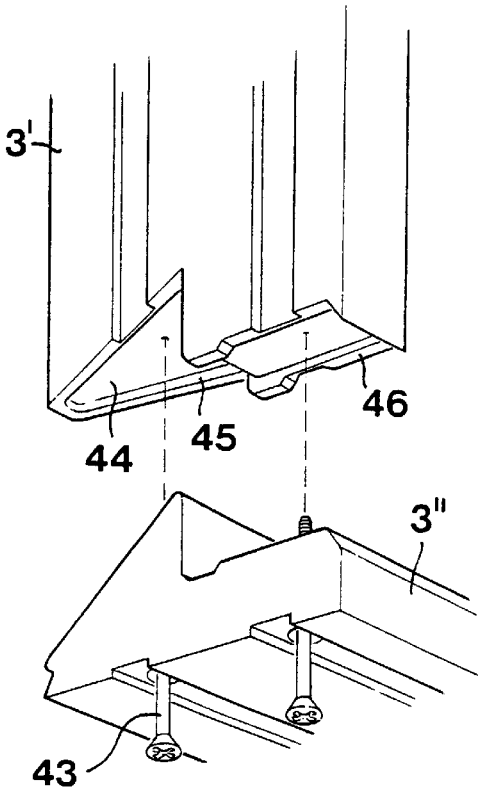
Figure 10:
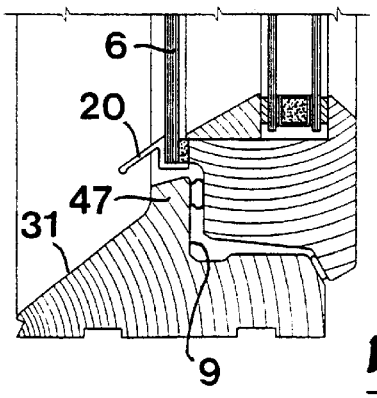
Figure 12:
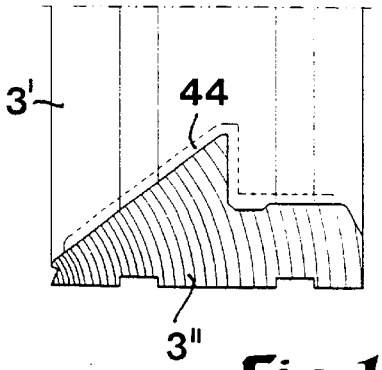

In the drawings:

FIG. 1 is a perspective view of a window structure according to the invention, FIG. 2 is a highly enlarged, partial horizontal section through the frame of the structure and the appurtenant window leaf which is shown in a closed state, FIG. 3 is a corresponding vertical section through the frame and the window leaf, FIG. 4 is a horizontal section through a casement side piece of an alternative embodiment of a casement of the structure, FIG. 5 is a cross section through a log, FIG. 6 is a corresponding cross section with dividing cuts made for the extraction of frame pieces for the frame of the structure, FIG. 7 is a cross section through an individual work piece for a frame piece, FIG. 8 is a cross section through a top or side piece of the frame, FIG. 9 is a cross section through a bottom piece of the frame, FIG. 10 is a cross section through a bottom piece according to an alternative embodiment, FIG. 11 is an exploded perspective view showing the design of a frame side piece in connection with a bottom piece, and FIG. 12 is a side view of said side and bottom pieces.

DETAILED DESCRIPTION OF PREFERRED EMBODIMENTS OF THE INVENTION

In FIG. 1 a window structure is shown comprising a wooden frame designated 1 in its entirety and a window leaf generally designated 2 being pivotable in relation to the frame. The frame 1 is composed of a top piece 3, two side pieces 3' and a bottom piece 3". The window leaf 2, which is inwardly opening relative to the frame 1, is of a multi glazing type and comprises a casement 4 which, like the frame, is composed of a top piece 5, two side pieces 5' and a bottom piece 5". In the example the casement 4 carries an outer glass pane 6 as well as an inner glass pane unit 7 (see also FIGS. 2 and 3). The window leaf 2 is in a conventional way pivotally suspended on the frame 1 through a suitable number of butt hinges or articulations 8.

Reference is now made to FIGS. 2 and 3 which in detail show a first embodiment of the window leaf 2.

According to the invention, the outer glass pane 6 does not consist of a conventional, untempered silicate glass, but of a safety glass which in practice may be made of either a tempered glass or a laminated glass. This means that the shown, single glass pane 6 may be made strong enough to form a carrying component in the window leaf in its entirety. In turn, this makes possible that the wooden casement may in its entirety be located on the inside of the outer glass pane, meaning that the pane, in the closed state of the window leaf, has its edge portions located between the casement and the inwardly facing shoulder surfaces of the frame, which surfaces are designated 9 in FIGS. 2 and 3. In case the pane 6 consists of tempered glass, it is fully sufficient that it has a thickness of about 4 mm, although also more solid panes are feasible, in particular when a great safety against burglary is desired. When laminated glass is used, the thickness may be in the range of 6–9 mm. The glass may be clear as well as coloured and also consist of fire-retardant glass or anti-dazzling and energy-saving glass of a tempered type respectively.

The inner pane unit 7 is in the example shown to consist of an insulating glass which in a known way is composed of two mutually separated glass planes 7', 7" interconnected through an edge frame 10. In this connection, it should be pointed out that the inner pane unit 7 may consist of any preferably transparent glass pane as well as that the window leaf may include more than one inner glass pane in addition to the outer glass pane 6.

All the four casement pieces 5, 5', 5" may be manufactured in one and the same embodiment, i.e. with an identical cross section profile. Thus, all the casement pieces include a main part 11 which in the area of an inside has a bead 12 protruding towards the centre of the casement. Said bead constitutes an inner shoulder for the insulation glass 7. It should be especially noted that the bead is delimited by an obliquely bevelled surface 12'. A border 13 serves as an outer surface for the insulation glass 7 which border is fastened on the main part 11, preferably by means of a screw joint (not shown). The border 13 is wedge-shaped. More precisely, the border has cross-section-wise the shape of a right angled triangle, the hypotenuse and long cathetus of which converge outwardly. By this wedge-shape of the border 13, a maximum viewing or panoramic angle is obtained for each given size of the edge frame 10 of the insulation glass. It may also be pointed out that sealing and/or spacing elements 15, e.g. tape of polycloroprene rubber, may be inserted between on one hand the insulation glass and on the other hand the bead 12 and the border 13 respectively. The outer glass pane 6 is, along one side edge thereof, connected to a casement side piece 5' via a suitable number (e.g. two) of butt hinges or articulations 16. In practice, these butt hinges may have one half thereof fastened with screws in a countersink in the outside of the casement side piece and the other half thereof fastened on the inside of the outer glass pane 6 by a layer of adhesive as well as screws or rivets 17 having semi-spherical heads which are not easily affected from the outer side of the outer glass pane. The outer glass pane 6 is connectable, at the opposite side edge thereof, to the second casement side piece 5' by means of one or several locking means 18, e.g. in the form of hooks, said hooks gripping the edge portion of the glass pane 6 in the position shown in FIG. 2. When the locking means are released, the outer glass pane 6 may be pivoted relative to the casement around the hinges 16 in order to clean the interior of the window leaf.

Elastic sealing bodies 19, e.g. borders of silicon rubber, act between the outer glass pane 6 and the shoulder surfaces 9 on the top and side pieces of the frame. An analogous sealing body 19' act between the bottom piece 5" of the casement and the shoulder surface 9 on the bottom piece of the frame. As may be seen in 3, said bottom sealing body abuts against a shoulder surface 48 situated below and inside an upper projection 49 on the lower casement piece 5".

In the area of the lower edge of the outer glass pane 6, a drip mould 20 is arranged which in practice may consist of aluminium or plastic. In the example, this drip mould comprises a vertical rib abutting against the outside of the glass pane 6 and which, at the lower edge thereof, transforms into a horizontal flange touching against the lower edge surface of the glass pane. The rib transforms, at the upper edge thereof, to an oblique flange leaning outwards/downwards from the rib. Water running down along the outside of the outer glass pane hits the drip mould 20 so as to be distanced from the outer glass plane before it falls down onto the bottom piece of the frame. Said mould also serves as an edge protection against direct outer damage on the lower edge portion of the glass pane.

One or several locking means 21 (see FIG. 2) may be included in the side casement piece which is distanced from the main butt hinges 8, the purpose of said locking means being to keep the window leaf locked in the frame.

In the embodiment according to FIGS. 2 and 3, each individual casement piece 5, 5', 5" has the form of a homogenous wooden body made in one single piece. In FIG. 4 an alternative embodiment is shown according to which the casement piece is composed of two part bodies 22, 23 interconnected by gluing. This embodiment may in practice be particularly advantageous in connection with the frame production procedure which will be described below.

From FIGS. 2 and 3 it is clear how each individual casement piece 3 comprises a first part 24 facing outwards in the wall opening in question, said part being, at least partly, thicker than a second part 25. The transverse shoulder surface 9 is formed between these parts 24, 25 by the fact that the first part 24 is, at least partly, thicker or broader than the second part 25. Each frame piece has an inwardly facing or in-door located long side surface 26 and an opposite, outwardly facing long side surface 27. A plane surface or side, facing the surrounding portions of the wall opening is designated 28. In this surface one or several grooves 29 are cut out, in a known way, the main purpose of the grooves being to break possible moisture migration between the outside and the inside of the frame. A surface on the other part 25 being mainly parallel to the surface 28 and facing the centre of the frame is designated 30. Said surface extends inwardly from the transverse shoulder surface 9.

Unlike conventional frame pieces having a substantially rectangular basic shape, the first part 24 of each frame piece is delimited by two surfaces converging outwardly and at an acute angle relative to each other, one surface being constituted by the surface 28 and the other one being designated 31. These oblique surfaces 28, 31 emanate from dividing cuts made in an initial log, said cuts extending genuinely radially from the area of the centre of the log. This results in that the annual rings in the wood material of the first part 24 of the frame piece are orientated in such a way that imagined tangents to individual annual rings cut through the surfaces 28, 31 substantially perpendicularly to the planes of the surfaces. Furthermore, older annual rings are situated closest to the free, narrow edge surface 27 of the part 24.

Reference is now made to FIGS. 5 to 10 illustrating the principle according to which the frame pieces of the window structure according to the invention are produced. FIG. 5 shows a cross section of a log 32 which serves as a starting point for the production. The individual annual rings of the log are designated 33. Although different kinds of wood may be used, redwood (Swedish redwood) is preferred in practice, in particular slowly grown-up redwood logs in which the veining is dense and in which the heartwood is of a greater extension. The heartwood of a redwood log contains a large share of naturally stored resin compounds which constitute a natural protection against rot fungi and have as well a greatly reduced tendency to absorb moisture in comparison to the superficial sap. Therefore, it is of great value if the heavily resinous heartwood has such a great extension in the initial log that the first part 24 of the frame piece will consist of such heartwood in its entirety. In practice, the diameter of the heartwood in a log, which should have a diameter of at least 320 mm, should attain at least ⅔ of the log diameter.

In FIG. 6 is shown how the log 32 is given eight genuinely radial, equidistantly separated dividing cuts 34, 34', e.g. by means of a disc saw blade. Said cuts 34, 34' separate eight pieces-of-cake-like blanks or work pieces which each is given two dividing cuts 35, 36 directed perpendicularly to each other. Said cuts separate a piece of wood designated 37. Furthermore, a cut 38 directed perpendicularly to the cut 35 separates a residual piece 39. As may be seen in FIG. 7, the extracted frame work piece 40 has a cross section area which is at least somewhat larger than the cross section area of the final frame piece 3. The diminutive, cross-section-wise triangular inner portion which is designated 41 in FIG. 7 and which portion mainly consists of the juvenile wood of the log, is removed from the work piece 40, most suitably before seasoning.

As is illustrated in FIG. 7, the frame piece 3 shown with dotted lines is finally extracted by means of a suitable finishing treatment, e.g. profile-milling and/or planing. In doing so, the plane surface 28 of the finished frame piece is provided in close connection to a cut surface 34, while the surface 31 is closely connected to a cut surface 34'.

In FIG. 8 the final profile shape of a top or bottom piece 3, 3' to the frame is shown, while FIG. 9 shows the profile shape of a bottom piece 3". In practice, the angle between the surfaces 28, 31 converging outwardly should be within the range of 20–60°, suitably 35–50°. As may be seen by a comparison between FIG. 8 and FIG. 9, this angle is larger for the individual top or bottom piece 3, 3' than for the bottom piece 3". Thus, in FIG. 8 it is shown how the angle between the surfaces 28 and 31 attains about 45°, while the corresponding angle in the bottom piece 3" according to FIG. 9 is about 38°. In both cases, however, the thickness of each second part 25 as well as the width of the shoulder surface 9 are mainly equally large, i.e. the distances between the surface 28 and the edge 42 are mainly equally large. The angle difference between the two types of frame pieces according to FIGS. 8 and 9 means, however, that the outer part 24 of the bottom piece 3" obtains a larger depth than the corresponding outer part 24 of the frame pieces 3 and 3' respectively according to FIG. 8. In other words, the shoulder surface 9 of the frame bottom piece 3" is situated at a greater distance from the edge portion facing outwards than the corresponding shoulder surface of the top piece and the side pieces. The effect of this difference is clear from FIG. 3 showing how the shoulder surface 9 of the bottom piece 3" is situated inside the outer glass 6 of the window frame at the same time as the outer glass, in turn, is situated inside the shoulder surfaces 9 of the top and side pieces of the frame. Thus, water falling down from the drip mould 20 will drip down onto the outwardly exposed, oblique surface 31 of the frame piece at a safe distance from the shoulder surface 9 of the bottom piece. In this connection, it should be pointed out that the top side of the frame bottom piece 3" in practice may be covered by a window-sheet which is not shown in the drawings.

In the alternative embodiment of the frame bottom piece 3" which is shown in FIG. 10 there is, in the transition between the oblique surface 31 and the shoulder surface 9 for the frame, a heightened ridge 47 the purpose of which is to prevent water, which by a heavy wind may be driven upwards along a window-sheet on the surface 31, from penetrating into the interior of the frame. The interior of the ridge 47 is part of the shoulder surface 9 while the exterior of the ridge is situated a bit inside of the free, outer edge of the drip mould 20. In the embodiment according to FIG. 10, the ridge 47 constitutes an integral part of the wooden material of the frame bottom piece. However, it is also conceivable to provide the frame bottom piece according to FIG. 9 with a separate mould, e.g. of aluminium or plastic, which fulfils the same water preventing purpose as the ridge 47.

As may be seen in FIG. 11, the individual frame pieces in the frame may be interconnected through screw joints comprising a suitable number of screws 43. Possibly, the screw joint may be supplemented by an adhesion joint between the contact surfaces of the frame pieces. In FIG. 11 it may further be seen how the individual side piece 3' has, at least at the bottom end thereof, a profile shape corresponding to the contour shape of the top side of the bottom piece 3" of the frame (a corresponding form fit is also occurring against the frame top piece 3).

According to a particularly preferred embodiment of the invention, there is, in the bottom end of each side piece 3', recessed a countersink 44 delimited by a perimetrical, endless bead or border 45 the lower end surface 46 of which constitutes the shoulder surface of the side piece towards the top side of the bottom piece. The depth of the countersink 44 may in practice attain 3–4 mm, and the width or thickness of the bead 45 may be in the range of 4–5 mm. When the two frame pieces are interconnected, the countersink 44 forms a cavity facilitating evacuation of possible penetrating moisture. When the screws 43 are tightened, a large surface pressure is applied to the relatively thin bead 45 leading to a compression of the fibre structure in the bead, i.e. the wood material in said bead attains a larger density or compactness than the other wood material in the frame side piece. This leads to the advantageous effect that moisture penetration to the cavity is made more difficult, and absorption of water vertically in the frame piece through capillary effects being counter-checked.

The casement 4 of the window leaf 2 may in practice be composed of individual frame pieces extracted from the wooden work pieces 37 which, according to FIG. 6, are separated by means of cuts 35, 36 from the work pieces 40 forming the frame pieces. The work pieces 37 mainly consist of sap having relatively loose veining, but this does not constitute any practical disadvantage inasmuch as the casement 4 is in its entirety situated inside of the outer glass pane 5. This means that the casement is not exposed to climatic influences in the form of precipitation, wind or direct insolation. In those cases when the initial log 32 has a limited diameter, the work pieces 37 will not be thick. However, this does not prevent the work pieces from being used in the production of the casement, viz. according to the embodiment shown in FIG. 4 where two relatively weak part bodies 22, 23 together form a more solid casement piece. When composing the frame piece according to FIG. 4, the part body 23 exposed inwards may be selected from first rate, knotfree material, while the part body 22 may be made of work pieces of an inferior quality since this part body is hidden.

In FIGS. 2 and 3 it may be seen how the individual frame piece in the transition between the inner long side surface 26 and the surface 30 facing the centre of the window has an obliquely bevelled surface 50 co-operating with a surface 51 inclined by an equal angle formed on a bead 52 protruding from the individual casement piece as a whole and partly overlapping the frame piece. Advantageously, an elastic sealing member 53 is arranged between the surfaces which member is most suitably fastened on the bead 52. The oblique surfaces 50 on the four frame pieces of the frame together form a wedge-shapedly tapering, female-like seat which—when the window is closed—receives correspondingly wedge-shapedly, tapering male-like portion of the casement delimited by the oblique surfaces 51. This leads to the result that the casement in connection with closing in an advantageous way is centred in the frame and contributes to stiffen the window structure in its entirety.

The advantages of the invention are numerous. By using a strong outer glass pane, in itself forming a carrying, independent unit in the window frame, and arranging the wooden frame—serving solely as a carrier of the inner glasses—in its entirety inside the outer glass pane, the frame is effectively protected from the exposure of climatological stresses in the form of e.g. precipitation and direct insolation. This means that the frame may preserve all the positive characteristics of the wood and in spite of this obtain a long lifetime without the need for extensive maintenance work. In addition, glass damage caused by external damage, e.g. stone-throwing or ball-throwing, will be effectively neutralized. Furthermore, the fact that the outer safety glass, whether the same is made of tempered or laminated glass, is hard to break and force, means that the window structure with difficulty may serve as a way of burglary. Another advantage is that the window structure in its entirety offers a maximum viewing or panoramic angle not only as a consequence of the design of the frame with wedge-shapedly tapering outer parts but also as a consequence of the fact that the borders keeping the inner glass in place are in a corresponding way wedge-shaped. Therefore, the light transmission to the inside of the window structure will be optimal. A useful advantage in practice is further gained through the obliquely bevelled surface 12" on the bead 12 of the casement bottom piece 5". By the fact that this surface leans obliquely inwards/downwards the whole way from the sealing element 15, it is guaranteed that possible condensing water which may run down along the inside of the glass 7 does not remain on the casement bottom piece.

FEASIBLE MODIFICATIONS OF THE INVENTION

The invention is not solely restricted to the embodiments described and shown in the drawings. Thus, it is conceivable to combine the window frame according to the invention with other types of frames than those shown in the drawings, although such frames are preferred in practice. The principle of the invention may also be applied to window doors.

I claim:

1. A window structure comprising a frame having a shoulder surface and a pivotable window including a casement pivoted to the frame, and at least a pair of first and second glass substrates with edge portions carried by said casement, said second glass substrate having an inside surface, the improvement wherein said second glass substrate is a safety glass substrate, and wherein said first glass substrate is positioned adjacent said inside surface of said second glass substrate and connected thereto, the edge portions of said second glass substrate, when in a closed position, being positioned between said casement and said shoulder surface, said second glass substrate having side edges, pairs of said side edges located in opposed relationship relative to each other, one of said pair of said side edges thereof being movably connected to said casement to permit pivoting of said second glass substrate relative to said casement, the other of said pair of side edges being associated with said casement via locking means to thereby retain said second glass substrate against said casement.

2. The window structure according to claim 1, wherein said casement has four individual casement components including a top member, a pair of side members, and a bottom member, each individual casement component having a main body and a bead, said bead projecting towards a central portion of said casement and forming a shoulder for said first glass substrate, said body having a border associated therewith and spaced from said bead, said first glass substrate mounted between said border and said bead, said border tapering outwardly from said first glass substrate towards said second glass substrate.

3. The window structure according to claim 2, wherein said bead includes an obliquely bevelled surface adapted to facilitate condensed water run-off.

4. The window structure according to claim 2, wherein said main bodies of said casement components comprise a pair of mutually joined bodies.

5. The window structure according to claim 2, wherein one of said side edges is a lower bottom edge, and wherein said second glass substrate includes a drip mold positioned along said lower bottom edge.

6. The window structure according to claim 1, said frame comprising a plurality of wood frame members, each having a first body portion adapted to face outwardly of a wall opening and a second body portion adapted to face inwardly of said wall opening, said first body portion having a portion thereof of a greater thickness than a thickness of said second body portion whereby said first and second body portions form said shoulder surface along a side of said frame, said first body portion comprising a pair of converging surfaces wherein said converging surfaces converge outwardly at an acute angle relative to each other, said first body portion having a narrow end which is narrower than said second body portion and which has a free edge, the wood for said wood frame members being formed from wood stock having spaced generally annular growth rings in which the rings of the wood vary from shorter ring segments of older tree growth to longer ring segments of newer tree growth, the orientation of said annular ring segments of the wood, in cross-section, being such that the older shorter ring segments are closer to said free edge of said narrower end of said first body portion and wherein said annular rings are generally perpendicularly oriented, in cross-section, with respect to the plane of said converging surfaces of said frame.

7. The window structure according to claim 6, wherein said wood casement has a top member, a pair of side members and a bottom member and wherein each of said top, side and bottom members includes an outside surface, the outside surface of said bottom member having a greater depth than the corresponding outside surfaces of said top and side members whereby said shoulder surface of said frame member is located outside said second glass substrate.

8. The window structure according to claim 7, wherein each of said side members includes a bottom end and a top end, each of said bottom ends having a profile shape, said profile shape of said bottom end corresponding to the profile shape of the top end of said side members, said bottom end having a countersunk portion forming a recess therein and delimited by a perimetrical continuous bead or border, said bead or border having a lower end surface forming a contact surface of said side members relative to a top surface of said bottom frame member.

9. The window structure according to claim 7, wherein the angle between said converging surfaces (29, 31) of said first body portion (24) is between about 20 to about 60°.

10. The window structure according to claim 8, wherein the angle between said converging surfaces (28, 31) of said first body portion (24) is between about 20 to about 60°.

11. The window structure according to claim 7, wherein the angle between said converging surfaces (28, 31) of said first body portion (24) is between about 35 to about 50°.

12. The window structure according to claim 8, wherein the angle between said converging surfaces (28, 31) of said first body portion (24) is between about 35 to about 50°.

13. The window structure according to claim 1, wherein said locking means comprises a hook.

14. The window structure according to claim 1, wherein said pair of side edges are movably connected to said casement by hinge means.

* * * * *